US011349214B2

(12) United States Patent
Piagentini

(10) Patent No.: US 11,349,214 B2
(45) Date of Patent: May 31, 2022

(54) FM BROADCAST ANTENNA

(71) Applicant: NICOMUSA, INC., San Diego, CA (US)

(72) Inventor: Dario Piagentini, San Diego, CA (US)

(73) Assignee: NICOMUSA, INC., San Diego, CA (US)

( * ) Notice: Subject to any disclaimer, the term of this patent is extended or adjusted under 35 U.S.C. 154(b) by 0 days.

(21) Appl. No.: 17/063,353

(22) Filed: Oct. 5, 2020

(65) Prior Publication Data

US 2021/0104822 A1 Apr. 8, 2021

Related U.S. Application Data

(60) Provisional application No. 62/910,625, filed on Oct. 4, 2019.

(51) Int. Cl.

| | |
|---|---|
| ***H01Q 5/48*** | (2015.01) |
| ***H01Q 1/12*** | (2006.01) |
| ***H01Q 9/46*** | (2006.01) |

(52) U.S. Cl.

CPC ..... *H01Q 5/48* (2015.01); *H01Q 1/1242* (2013.01); *H01Q 9/46* (2013.01)

(58) Field of Classification Search

CPC .. H01Q 1/1242; H01Q 1/1264; H01Q 1/1228; H01Q 5/48; H01Q 9/44; H01Q 9/46; H01Q 21/08; H01Q 21/24; H01Q 21/26

See application file for complete search history.

(56) References Cited

U.S. PATENT DOCUMENTS

| | | | | |
|---|---|---|---|---|
| 4,109,255 A * | 8/1978 | Silliman | ..... | H01Q 9/26 343/792 |
| 5,103,238 A * | 4/1992 | Mahnad | ..... | H01Q 21/26 343/821 |
| 2008/0291105 A1* | 11/2008 | Schadler | ..... | H01Q 21/08 343/793 |

* cited by examiner

*Primary Examiner* — Robert Karacsony

(74) *Attorney, Agent, or Firm* — CP Law Group PC; Cy Bates

(57) ABSTRACT

An FM broadcasting antenna is described having a mast, a pair of forward-facing elements, and a pair of rear-facing elements. The antenna makes use of angles between the antenna elements and the mast, a multi-diameter feed line, a multi-diameter center pin, and mounting points of a strap extending between at least one of the forward-facing elements, at least one of the rear-facing elements and the center pin, for achieving desired broadband and performance characteristics.

16 Claims, 10 Drawing Sheets

FM BROADCAST ANTENNA

CROSS-REFERENCE TO RELATED APPLICATIONS

This application claims benefit of priority with U.S. provisional application Ser. No. 62/910,625, filed Oct. 4, 2019; the entire contents of which are hereby incorporated by reference.

BACKGROUND

Field of the Invention

This invention relates to antennas; and more particularly, to an FM broadcast antenna.

Description of the Related Art

Frequency Modulation (FM) broadcast band is a frequency range in the United States is from 87.7 MHz to 107.9 MHz. The FM broadcast band is used by radio stations for purposes including commercial broadcasting, non-commercial educational public broadcasting, and non-profit varieties such as community radio.

The industry standard for the design of an antenna to broadcast in the FM band covers only about 10 MHz bandwidth for a single antenna. Since the entire FM bandwidth is a total of 20 MHz, it is typically necessary to use multiple antennas to cover the full FM range.

Voltage Standing Wave Ratio (VSWR) is a parameter that numerically describes how well an antenna's impedance is matched to the impedance of the radio or transmission line. For the radio to deliver power to an antenna, the impedance of the radio and transmission line must be well matched to the antenna's impedance. The smaller the VSWR is, the better the antenna is matched to the transmission line and therefore more power can be delivered to the antenna.

There is a need for an improvement in the design of FM broadcast antennas that will allow for a single antenna to broadcast over the entire 20 MHz bandwidth while still maintaining a low VSWR.

SUMMARY

The disclosure concerns an antenna comprising a mast having a proximal end and a distal end, a pair of forward-facing elements coupled to the mast between the proximal end and the distal end, and further comprising a pair of rear-facing elements coupled to the distal end. The pair of forward-facing elements include first and second antenna elements, each independently forms a first angle with the mast comprising between and inclusive of 46 and 50 degrees, and preferably 48 degrees. The pair of rear-facing elements include third and fourth antenna elements, each of which independently forms a second angle with the mast comprising between and inclusive of 40 to 44 degrees, and preferably 42 degrees. Furthermore, the first and second antenna elements and mast are configured within a first plane, and the third and fourth antenna elements and mast are configured within a second plane, wherein the first plane is orthogonal to the second plane.

In addition, the mast may include a transmission line having a plurality of transmission line diameters. The mast may further comprise a center pin coupled to the transmission line, the center pin having a plurality of pin diameters.

Other advantages and benefits may be further appreciated from the appended detailed descriptions.

BRIEF DESCRIPTION OF THE DRAWINGS

Other features, combinations, and embodiments will be appreciated by one having the ordinary level of skill in the art of antennas and accessories upon a thorough review of the following details and descriptions, particularly when reviewed in conjunction with the drawings, wherein.

DETAILED DESCRIPTION

Figure 1:
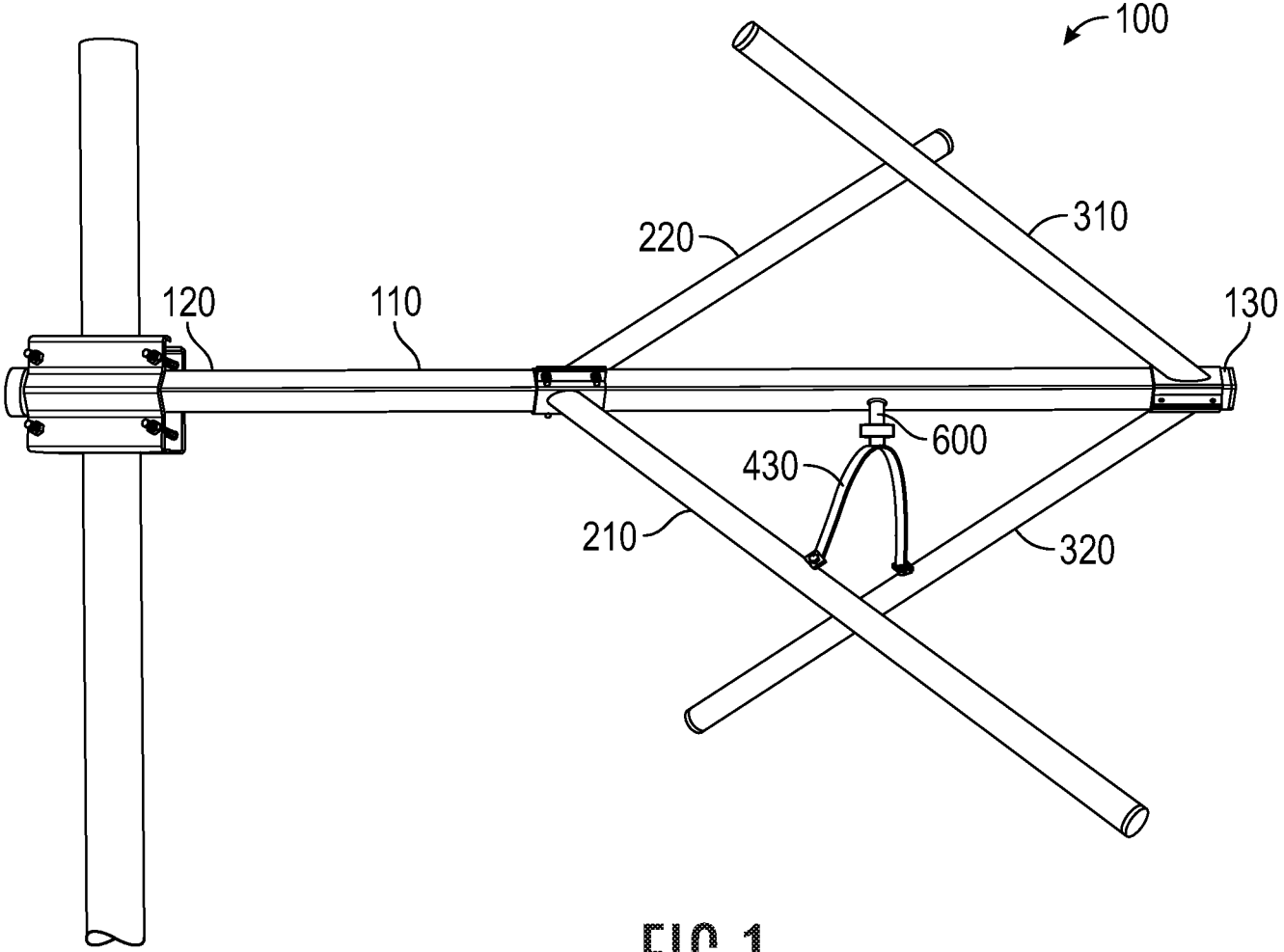
FIG. 1 shows a left side view of the antenna in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily understood by one having skill in the art upon a thorough review of the instant disclosure. In this regard, any number of embodiments that may combine one or more features of the illustrated examples can be made and used by one having skill in the art to achieve substantially the same effects of the invention. Accordingly, any reviewer of the instant disclosure should interpret the scope of the invention only by the claims, as such scope is not intended to be limited by the embodiments described and illustrated herein.

General Description of Embodiments

In a first embodiment, an FM broadcast antenna is disclosed, the antenna comprises a mast extending from a proximal end to a distal end. A pair of forward-facing elements are coupled to the mast at a position between the proximal and distal ends, the forward-facing elements including a first antenna element and a second antenna element. Each of the first and second antenna elements independently forms a first angle with the mast, the first angle comprising between and inclusive of 46 and 50 degrees, and preferably 48 degrees. Furthermore, each of the first and second antenna elements and the mast are configured within a first plane. Additionally, a pair of rear-facing elements are coupled to the mast at the distal end, and the rear-facing elements include a third antenna element and a fourth antenna element. Each of the third and fourth antenna elements independently forms a second angle with the mast, the second angle comprising between and inclusive of 40 and 44 degrees, and preferably 42 degrees. Each of the third and fourth antenna elements and the mast are configured within a second plane, wherein the first plane is orthogonal to the second plane. The angle of each element with respect to the mast and the orthogonal planar relationships provide a more robust and broadband antenna response.

The antenna may be designed to be circularly polarized. Alternatively, the antenna may be polarized linearly, such as horizontal polarization or vertical polarization.

Generally, the antenna may comprise a transmission line disposed inside the mast. The transmission line may extend from the proximal end, to the distal end or a point between the proximal and distal ends.

In some embodiments, the transmission line may comprise a plurality of transmission line diameters. A transmission line with multiple diameters, at least along a path within the mast, provides a more robust and broadband antenna response.

In the first embodiment, the antenna may comprise a center pin. The center pin is configured to couple to the transmission line. The center pin may comprise a plurality of pin diameters. Again, it was uniquely discovered that varying the diameter of the center pin at various positions as shown in the drawings results in a more robust and broadband antenna performance.

In a preferred embodiment, the center pin comprises brass; however, it can be appreciated by one having skill in the art that other conductive materials may be alternatively used.

In the first embodiment, the antenna may comprise a first attachment element coupled to the first antenna element, and a second attachment element coupled to the fourth antenna element. The center pin is configured to couple to each of the first and second attachment elements via an electrically conductive strap extending therebetween.

In some embodiments, the antenna may comprise a radome. The radome is coupled to the mast at a position between the forward-facing and rear-facing elements, and the radome is configured to surround the center pin for protecting the center pin from the environment.

Generally, the mast may comprise a cross-section, the cross-section being characterized as rectangular. In this regard, the antenna elements can be coupled to the mast in a manner that easily results in orthogonality and/or coplanar orientation of the antenna elements with respect to one another.

In the first embodiment, the forward-facing elements and rear-facing elements are spaced a distance apart. The preferred distance between the forward-facing elements and the rear-facing elements is one to three times a length of the rear-facing elements.

In some embodiments, the antenna comprises a mast extending from a proximal end to a distal end and a multi-diameter feed line disposed inside the mast. The multi-diameter feed line extends from the proximal end to the distal end, or to a position between the proximal and distal ends, and the multi-diameter feed line comprises a plurality of segments each comprising one of a plurality of diameters. The antenna further comprises a center pin coupled to the multi-diameter feed line at or near the distal end, the center pin comprises a plurality of portions each comprising one of a plurality of pin diameters. Additionally, the antenna includes a pair of forward-facing elements and a pair of rear-facing elements. The pair of forward-facing elements are coupled to the mast at a position between the proximal and distal ends. The forward-facing elements include a first antenna element and a second antenna element. The pair of rear-facing elements are coupled to the mast at the distal end. The rear-facing elements include a third antenna element and a fourth antenna element. The center pin is coupled to the first and fourth antenna elements via the strap.

The antenna provides a wide bandwidth, for example and without limitation, a bandwidth of 20 MHz to cover the entire FM broadcasting band. The invention utilizes independent features including: particular angles of the antenna elements, a multi-diameter transmission line, a multi-diameter center pin, and a strap coupled to antenna elements at positions for achieving the desired bandwidth, alone or in any combination, to achieve this broadband response.

Manufacturing

Generally, the antenna elements and mast are made of metal, such as, for example and not limitation, 40 mm square pipe stainless steel AISI 304. However, it would be possible to manufacture components of the antenna using composite materials, thermoforming, and the like. Otherwise, the antenna elements and mast can be fabricated in accordance with the knowledge and abilities of one having skill in the art.

The transmission line of the antenna is generally made of aluminum, but other conductive materials may also be used. An embodiment having varying diameters along the transmission line can be fabricated in accordance to one having skill in the art. Spacers can be used along the body of the transmission line to hold the transmission line firmly inside the mast. The shape of the spacers should match the cross-section of the mast to ensure proper fit.

Generally, the center pin is made of a conductive material such as brass, though other conductors may be similarly used. To optimize performance of the antenna, the center pins should be threaded to have three total diameters. A preferred embodiment would have the ends comprise M8 thread, with the middle portion comprising M12 thread (See FIG. 8).

The radome can be made of material that is electromagnetically transparent so as to not interfere with the antenna transmission. It is preferable for the material to have high strength and resistance to weathering elements and corrosion. Therefore, fiberglass is a preferable material that can be used to construct the radome. The size and shape of the radome can be fabricated by one having skill in the art, taking into consideration factors such as size and location of the center pin and the its surrounding elements. The purpose the radome is to protect the center pin "hotpoint" from weather such as rain and snow. The radome can be obtained commercially, for example the rad-77 (https://www.nicomusa.com/antennas-bkg77).

Generally, the strap is made of a conductive material, such as stainless steel, that is capable of transmitting a radio signal. Having a material that resists corrosion may also be preferable. The strap can be fabricated with the level and knowledge of one having skill in the art.

The antenna connector at the end of the transmission line can be obtained commercially, for example and without limitation the 172113 (https://www.amphenolrf.com/connectors/n-type-connectors.html?gender=629764), a standard N-type female connector manufactured by Amphenol RF. Alternatively, other connectors may be used, such as the 7/16 DIN female connector and the 7/8 EIA flange connector, which can also be obtained commercially from well-known sources such as Digikey (https://www.digikey.com).

Each of the components of the antenna and related system described herein may be manufactured and/or assembled in accordance with the conventional knowledge and skill in the art.

Definitions

For purposes herein the term "FM" means frequency modulation, which is a method of encoding information on a carrier wave. FM broadcasting uses frequency modulation to broadcast a radio signal, which resides between 88 MHz-108 MHz.

The term "radome" means a structural weatherproof enclosure that protects an antenna from weather conditions such as ice and snow.

The term "VSWR" stands for "Voltage Standing Wave Ratio", and is a measure of how well an antenna is impedance matched to a transmission line. A lower VSWR signifies that the antenna is well-matched and will more efficiently transmit the signal.

First Illustrated Embodiment

Now turning to the drawings, FIG. 1 shows a left view of an antenna (100) according to a first illustrated embodiment. The antenna comprises a mast (110), the mast having a proximal end (120) and a distal end (130). A first antenna (210) and a second antenna element (220) are coupled to the mast at a position between the proximal end and the distal end. The first and second antenna elements are forward-facing. At the distal end is coupled a third antenna element (310) and fourth antenna element (320). The third and fourth antenna elements are rear-facing. A center pin (600) extends out from the mast at a location between the first and fourth antenna elements. Furthermore, the center pin is coupled to each of the first and fourth antenna elements via a strap. The orientation of the antenna can be such that the center pin is pointing upwards or downwards. Although either is acceptable, having the center pin oriented gravitationally downwards does have advantages related to drainage.

FIG. 1 further shows the mast having a rectangular cross-section. This type of mast structure can be appreciated by those having skill in the art as having a rigid structure and ease of assembly for coupling the first through fourth antenna elements to the mast. However, it can also be appreciated by those having skill in the art that alternative mast cross-sections may alternatively be used.

Figure 2:
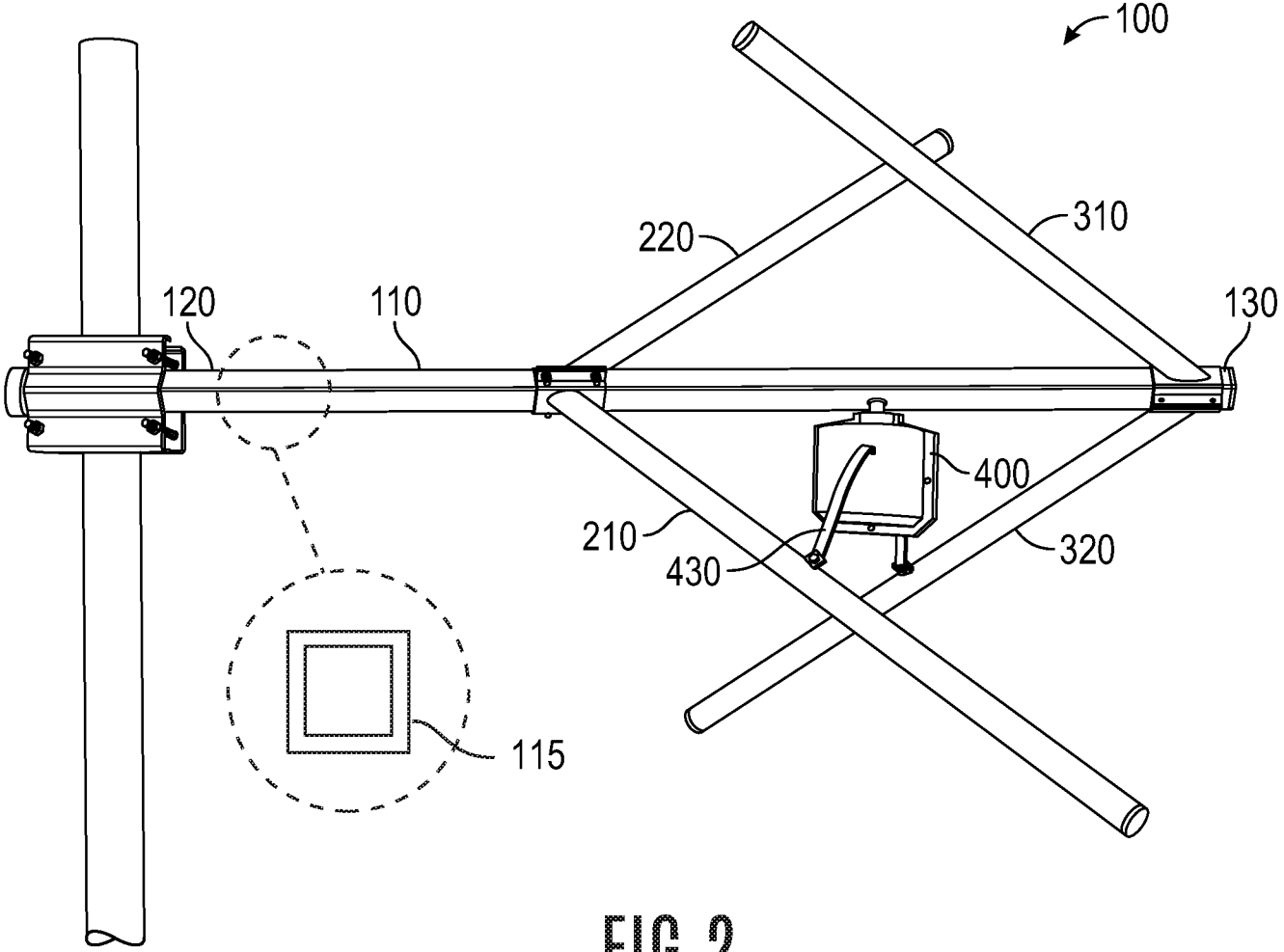
FIG. 2 shows a left side view of the antenna in accordance with the first illustrated embodiment and having an optional radome feature.
Figure 10:
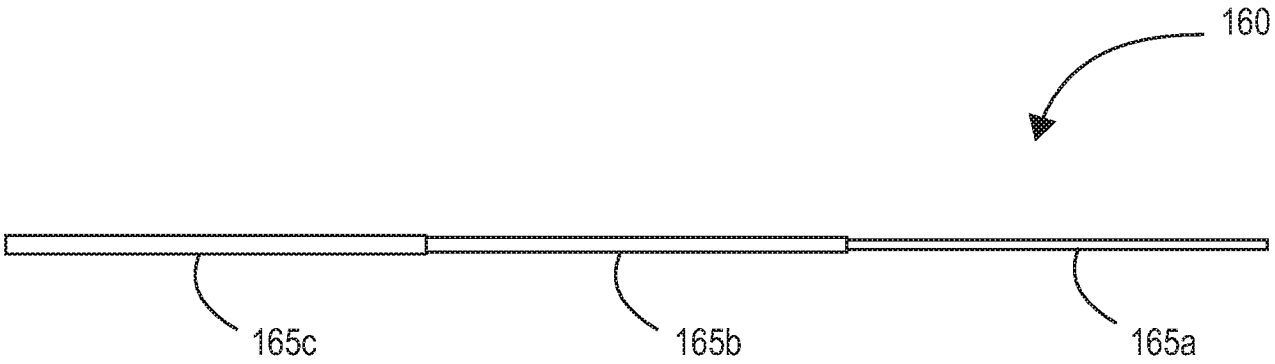
FIG. 10 shows a multi-diameter feed line for use in accordance with certain embodiments.

FIG. 2 shows a left view of the antenna (100) according to a second illustrated embodiment. Here, the antenna comprises a mast (110), the mast comprises a proximal end (120) and a distal end (130). The mast is shown optionally having a cross-section (115) that is in the shape of a rectangle. First and second antenna elements (210 & 220 respectively) are each coupled to the mast between the proximal end and distal end. Third and fourth antenna elements (310 & 320 respectively) are each coupled to the mast at the distal end. Disposed inside the mast is a transmission line referred to herein as a "multi-diameter feed line (160, FIG. 10)," the multi-diameter feed line comprises a plurality of segments (165, FIG. 10), each of the plurality of segments comprises one of a plurality of diameters, wherein the diameter of each section varies along a length of the multi-diameter feed line. Coupled to the multi-diameter feed line near the distal end is a center pin, the center pin (600, FIG. 8) is. Shown in FIG. 2 is an optional radome (400) which is configured to surround the center pin for the protection from weather. A strap (430) is coupled to the first and fourth antenna elements and is further coupled to the center pin. Relatively minor experimentation involving placement of the strap at one of a plurality of possible positions along each of the first and fourth elements will reveal optimal placement location for achieving desired bandwidth and antenna performance.

Figure 3:
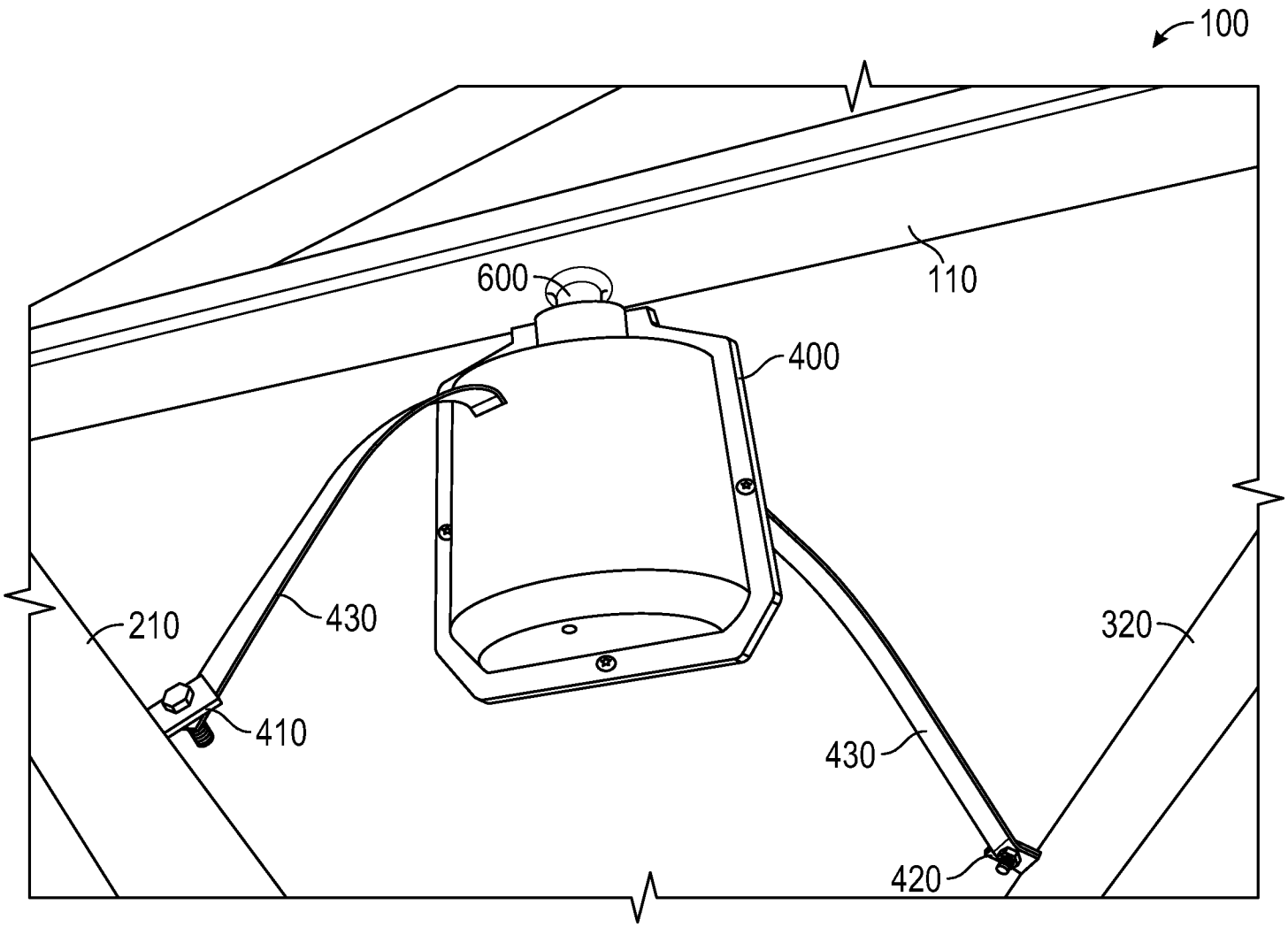
FIG. 3 shows a close-up view of radome feature of the antenna in accordance with the first illustrated embodiment.

FIG. 3 shows a closer view of the antenna (100) in accordance with the first illustrated embodiment, the antenna comprising first antenna element (210) and fourth antenna element (320) each coupled to the mast (110). The first antenna element includes a first attachment element (410), and the fourth antenna element includes a second attachment element (420). Additionally, coupled to the mast is a radome (400), which is surrounding a center pin (600) for an optionally added protection from weathering elements such as rain or snow. A strap (430) is coupled to the first and second attachment elements and further coupled to the center pin. The optional radome is configured to allow the strap to pass through the radome so as to allow the strap to couple to the center pin in addition to the first and second attachment elements.

Figure 4:
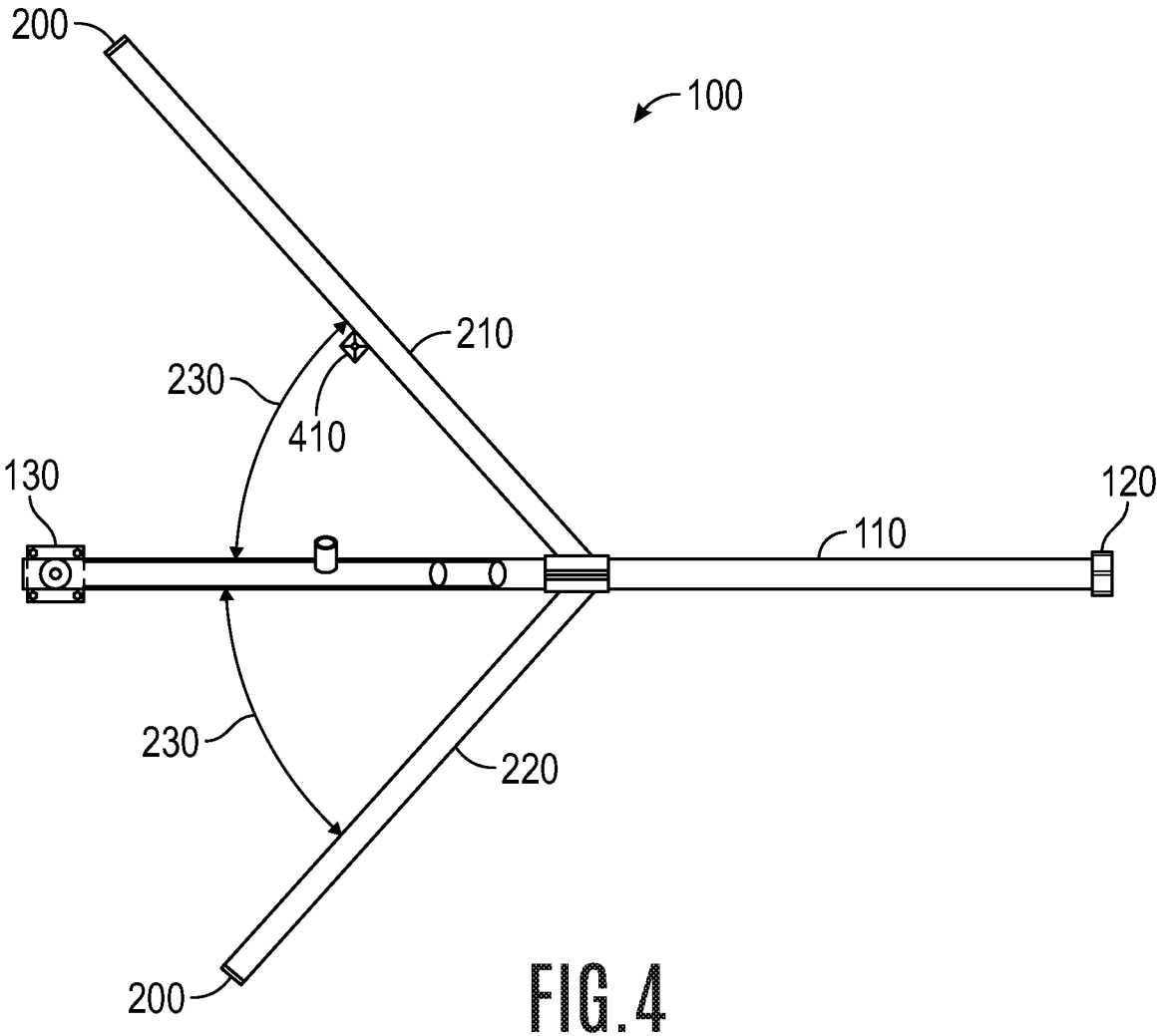
FIG. 4 shows a first side view of the antenna.

FIG. 4 shows another view of the antenna according to the first illustrated embodiment. The antenna comprises a mast (110) having a proximal end (120) and a distal end (130). A pair of forward-facing elements (200) are coupled to the mast between the distal end and proximal end. The pair of forward-facing elements comprise a first antenna element (210) and a second antenna element (220). FIG. 4 shows the first and second antenna elements are each coupled to a similar position along the mast. The first antenna element further includes a first attachment element (410). The first and second antenna elements each form a first angle (230) with the mast in between and inclusive of 46 and 50 degrees, and preferably 48 degrees. Third and fourth antenna elements (310 & 320, FIG. 5) are intentionally omitted from FIG. 4 for demonstrative purposes.

Various dimensions including length and radius of the first and second antenna elements may be used to achieve different performances at particular frequency bands. Preferred dimensions for performing in the FM broadcast band comprise the first and second antenna elements having a length of 960 mm and a radius of 16.5 mm. Furthermore, the preferred location of the first attachment element coupled to the first antenna element is 440 mm from the mast.

Figure 5:
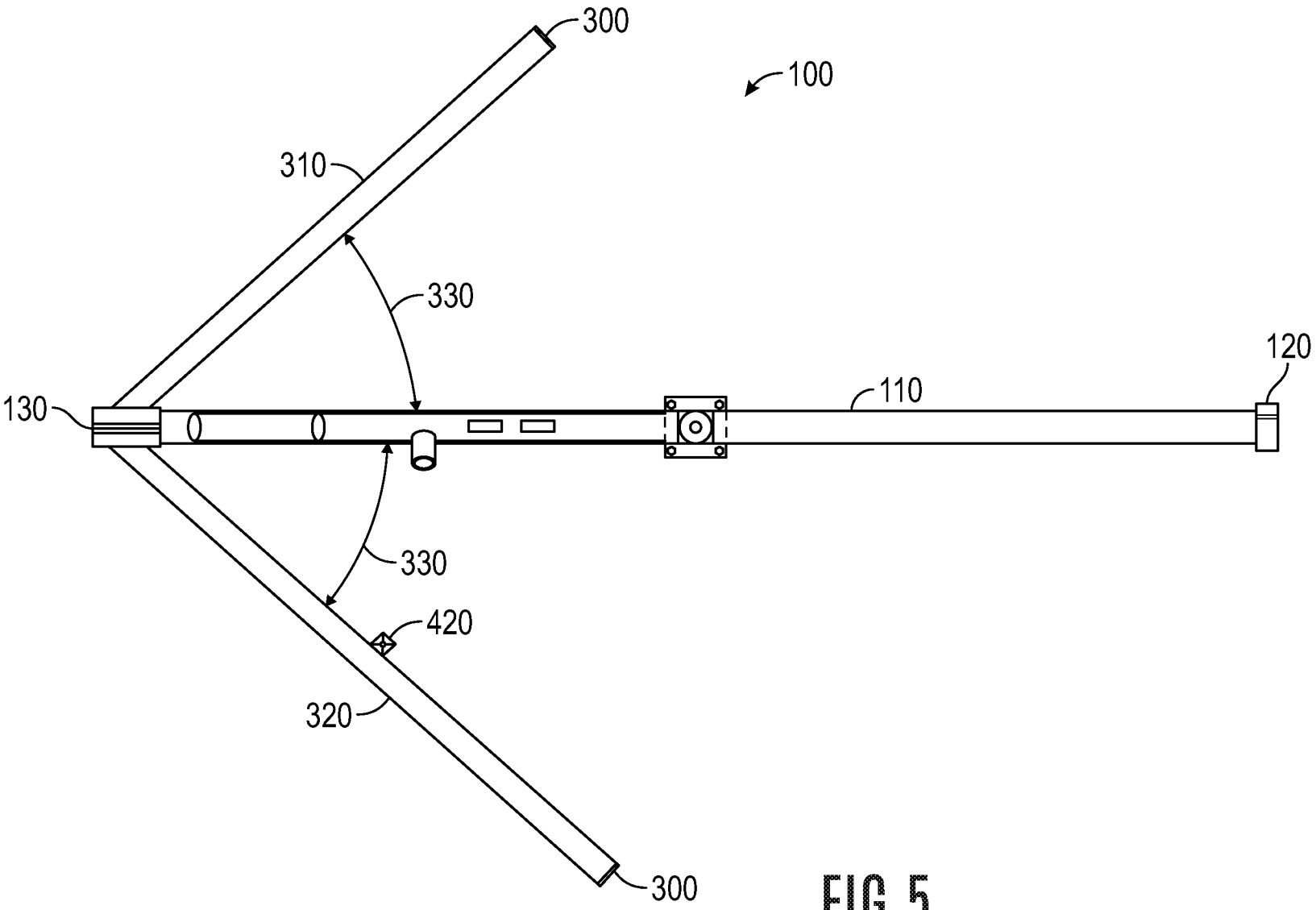
FIG. 5 shows a second side view of the antenna.

FIG. 5 shows yet another view of the antenna according to the first illustrated embodiment. The antenna comprises a mast (110) having a proximal end (120) and a distal end (130). A pair of rear-facing elements (300) are coupled to the mast at the distal end. The pair of rear-facing elements comprise third antenna element (310) and a fourth antenna element (320). The fourth antenna element further includes a second attachment element (420). The third and fourth antenna elements each form a second angle (330) with the mast in between and inclusive of 40 and 44 degrees, and preferably 42 degrees. First and second antenna elements (210 & 220, FIG. 4) are intentionally omitted from FIG. 5 for demonstrative purposes.

Various dimensions including length and radius of the third and fourth antenna elements may be used to achieve different performances at particular frequency bands. Preferred dimensions for performing in the FM broadcast band comprise the third and fourth antenna elements having a length of 830 mm and a radius of 17.5 mm. Furthermore, the preferred location of the second attachment element coupled to the fourth antenna element is 445 mm from the mast.

Figure 6:
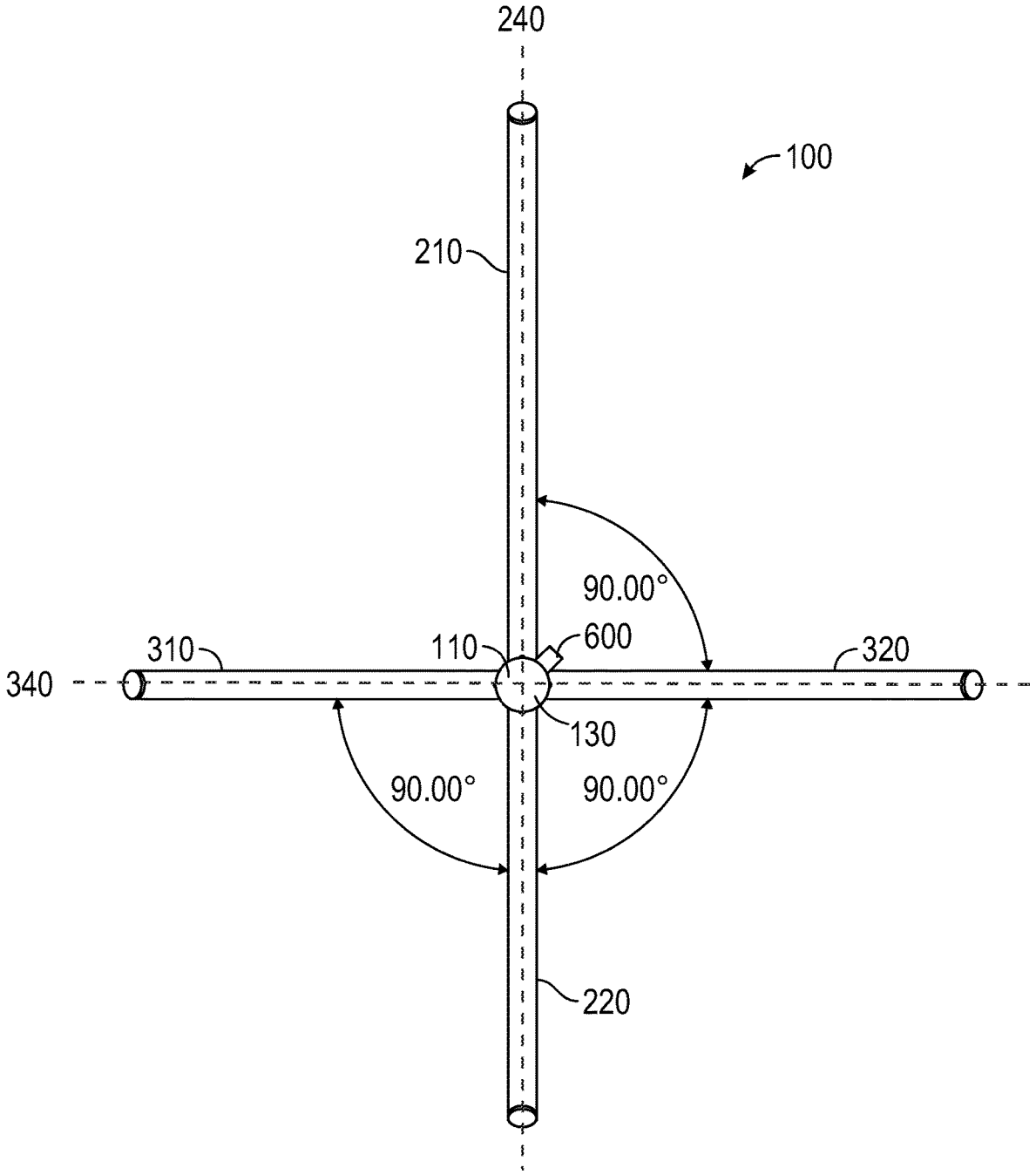
FIG. 6 shows a front view of the antenna.

FIG. 6 shows a front view of the antenna (100) according to the first illustrated embodiment. The antenna comprises a first through fourth antenna elements (210, 220, 310, 320, respectively) each coupled to the mast (110). The mast has a distal end (130) and a proximal end opposite the distal end. The first and second antenna elements form a first plane (240, extending through the paper) with the mast, and the third and fourth antenna elements form a second plane (340, extending through the paper) with the mast. The first plane is orthogonal to the second plane, such that the first and second antenna elements are each orthogonal to the third and fourth antenna elements. Additionally, a center pin (600) is coupled to the mast and disposed between the first and fourth antenna elements. The disposition of the center pin is configured to allow the center pin to be electrically coupled to both the first and fourth antenna elements via the strap.

Figure 7:
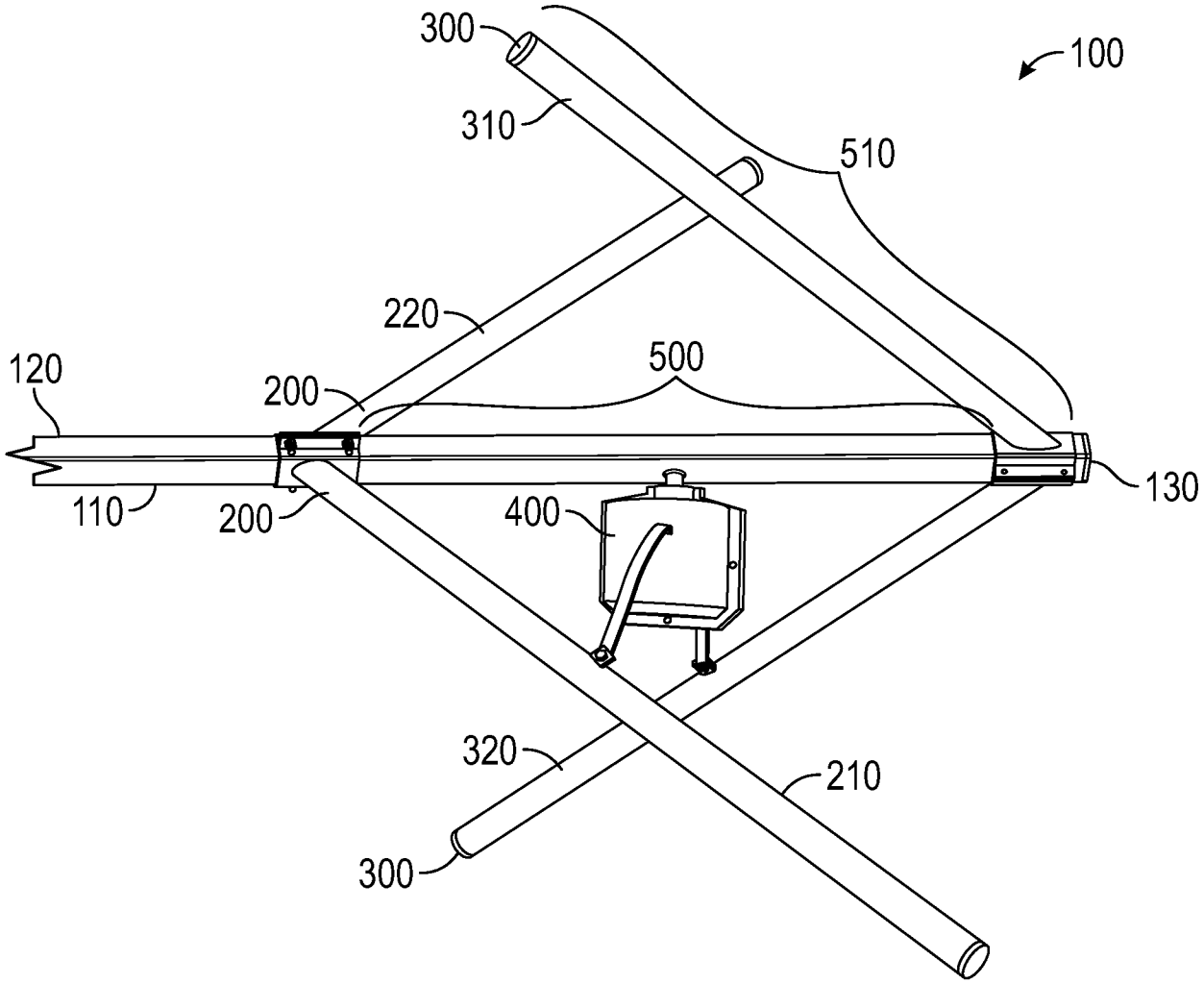
FIG. 7 shows a left side view of the antenna.

FIG. 7 shows a left view of the antenna (100) in accordance with the first illustrated embodiment. The antenna comprises a mast (110) with a proximal end (120) and a distal end (130). A pair of forward-facing elements (200) are coupled to the mast between the proximal end and distal end. The pair of forward-facing elements comprise a first antenna element (210) and a second antenna element (220). A pair of rear-facing elements (300) are coupled to the mast at the distal end. The pair of rear-facing elements comprise a third antenna element (310) and a fourth antenna element (320). An optional radome (400) is encapsulating a center pin (600 FIG. 8), the center pin coupled to the mast at a point between the forward and rear-facing elements. A distance (500) between the pair of forward-facing elements and rear-facing elements is shown. The optimal distance (500) for purposes of broadcasting on the FM band will be between one to three times a length of the rear-facing elements (510).

Figure 8:
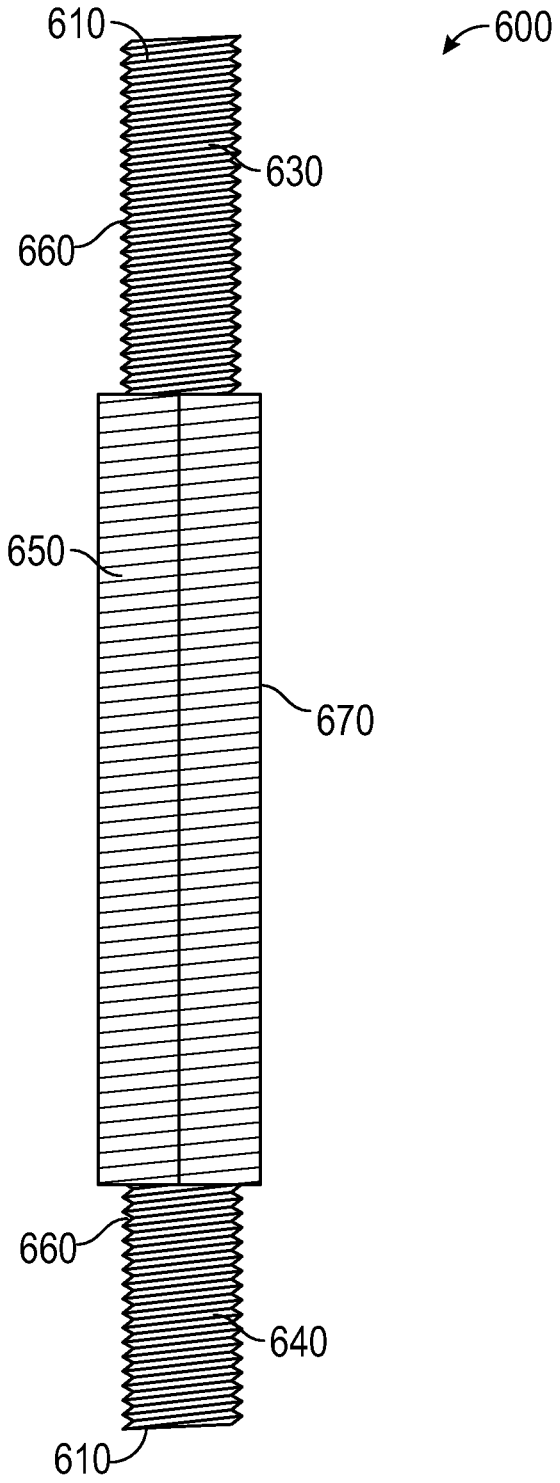
FIG. 8 shows a side view of a center pin of the antenna.

FIG. 8 shows a side view of a center pin (600) in accordance with the first illustrated embodiment. The center pin comprises a first portion (630) disposed at a first end (610), a second portion (640) disposed at a second end (620), and a third portion (650) disposed in between the first and second portions. The first and second potions comprise a first pin diameter (660) and the third portion comprises a second pin diameter (670). Further, the second pin diameter is greater than the first pin diameter. Different threads (e.g. M8, M12, and the like) may be used on the first through third portions to achieve different performances at particular frequency bands. In a preferred embodiment, the first portion includes M8×1.25 mm threading and spans a first length of 23 mm; the second portion includes M12×1.25 or M12×1.75 threading and spans a second length of 55 mm, and the third portion includes M8×1.25 mm threading and spans a third length of 12 mm, for a total length of 90.5 mm.

Figure 9:
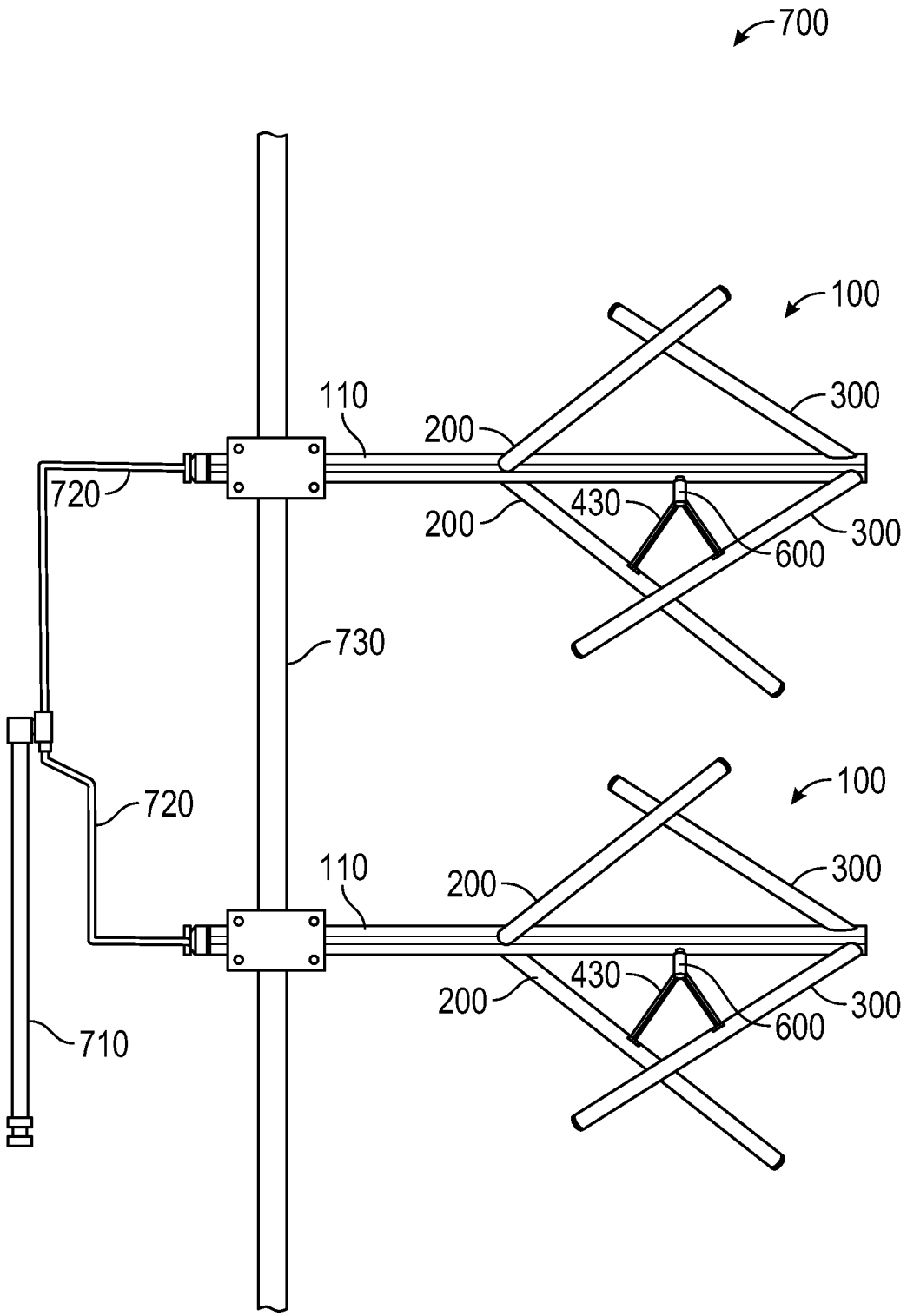
FIG. 9 shows a left side view of an array of antennas including the antenna of the first illustrated embodiment.

FIG. 9 shows an antenna array (700) comprising multiple antennas each provided in accordance with the first embodiment as described herein. As shown, the antenna array comprises two antennas (100), each of the antennas having a mast (110), a pair of forwarding-facing elements (200), rear-facing elements (300), a center pin (600), and a strap (430) coupled to each of the center pin, at least one of the forward-facing elements and at least one of the rear-facing elements. Each of the antennas further includes an interbay cable (720), wherein each of the interbay cables are electrically coupled to a power splitter (710). The mast of each of the antennas is coupled to a mounting pole (730). FIG. 9 shows an array of two antennas, but it will be appreciated by those having skill in the art that the array may comprise a number of antennas greater than two, for example, three, four, five, six, or more antennas spanning an array.

FEATURE LIST antenna (100)
mast (110)
cross-section (115)
proximal end (120)
distal end (130)
multi-diameter feed line (160)
plurality of segments (165)
plurality of diameters (166)
forward-facing elements (200)
first antenna element (210)
second antenna element (220)
first angle (230)
first plane (240)
rear-facing elements (300)
third antenna element (310)
fourth antenna element (320)
second angle (330)
second plane (340)
radome (400)
first attachment element (410)
second attachment element (420)
strap (430)
distance (500)
length of the rear-facing elements (510)
center pin (600)
first end (610)
second end (620)
first portion (630)
second portion (640)
third portion (650)
first pin diameter (660)
second pin diameter (670)
antenna array (700)
power splitter (710)
interbay cable (720)
mounting pole (730)

What is claimed is:

1. An antenna, comprising:

a mast extending from a proximal end to a distal end;

a pair of forward-facing elements coupled to the mast at a position between the proximal and distal ends, the forward-facing elements including a first antenna element and a second antenna element, each of the first and second antenna elements forming a first angle with the mast, the first angle comprising between and inclusive of 46 and 50 degrees, and each of the first and second antenna elements and the mast being configured within a first plane;

a pair of rear-facing elements coupled to the mast at the distal end, the rear-facing elements including a third antenna element and a fourth antenna element, each of the third and fourth antenna elements forming a second angle with the mast, the second angle comprising between and inclusive of 40 and 44 degrees, and each of the third and fourth antenna elements and the mast being configured within a second plane; and wherein the first plane is orthogonal to the second plane.

2. The antenna of claim 1, further comprising a transmission line disposed inside the mast, the transmission line extending from the proximal end to the distal end.

3. The antenna of claim 2, wherein the transmission line comprises a plurality of transmission line diameters.

4. The antenna of claim 2, further comprising a center pin coupled to the transmission line, the center pin comprising a plurality of pin diameters.

5. The antenna of claim 4, wherein the center pin comprises brass.

6. The antenna of claim 4, further comprising: a first attachment element coupled to the first antenna element, and a second attachment element coupled to the fourth antenna element, wherein the center pin is coupled to each of the first and second attachment elements via a strap extending therebetween.

7. The antenna of claim 6, further comprising a radome, the radome is coupled to the mast at a position between the forward-facing and rear-facing elements, the radome is configured to surround the center pin.

8. The antenna of claim 1, wherein the mast comprises a cross-section, the cross-section characterized as being rectangular.

9. The antenna of claim 1, wherein the forward-facing elements are spaced apart from the rear-facing elements by a distance of one to three times a length of the rear-facing elements.

10. An antenna, comprising:

a mast extending from a proximal end to a distal end;

a multi-diameter feed line disposed inside the mast, the multi-diameter feed line extending from the proximal end to the distal end, and the multi-diameter feed line comprising a plurality of segments each comprising one of a plurality of diameters;

a center pin coupled to the multi-diameter feed line at the distal end, the center pin comprising a plurality of portions each comprising one of a plurality of pin diameters;

a pair of forward-facing elements coupled to the mast at a position between the proximal and distal ends, the forward-facing elements including a first antenna element and a second antenna element, wherein the first and second antenna elements forma first angle with the mast, the first angle comprising between and inclusive of 46 and 50 degrees, each of the first and second antenna elements and the mast being configured with a first plane;

a pair of rear-facing elements coupled to the mast at the distal end, the rear-facing elements including a third antenna element and a fourth antenna element, wherein the third and fourth antenna elements form a second angle with the mast, the second angle comprising between and inclusive of 40 and 44 degrees, and each of the third and fourth antenna elements and the mast being configured within a second plane;

wherein the center pin is coupled to the first and fourth antenna elements via a strap.

11. The antenna of claim 10, wherein the first plane is orthogonal to the second plane.

12. The antenna of claim 10, wherein the center pin comprises brass.

13. The antenna of claim 10, further comprising: a first attachment element coupled to the first antenna element, and a second attachment element coupled to the fourth antenna element, wherein the center pin is coupled to each of the first and second attachment elements via the strap extending therebetween.

14. The antenna of claim 10, further comprising a radome, the radome is coupled to the mast at a position between the forward-facing and rear-facing elements, the radome is configured to surround the center pin and strap.

15. The antenna of claim 10, wherein the mast comprises a cross-section, the cross-section characterized as being rectangular.

16. The antenna of claim 10, wherein the forward-facing elements are spaced apart from the rear-facing elements by a distance of one to three times a length of the rear-facing elements.

* * * * *